US006332616B1

(12) United States Patent
Brown

(10) Patent No.: US 6,332,616 B1
(45) Date of Patent: Dec. 25, 2001

(54) JOUSTING GAME

(76) Inventor: David L. Brown, 18240 51st Ave. South, SeaTac, WA (US) 98188

( * ) Notice: Subject to any disclaimer, the term of this patent is extended or adjusted under 35 U.S.C. 154(b) by 0 days.

(21) Appl. No.: 09/598,400

(22) Filed: Jun. 20, 2000

(51) Int. Cl.[7] ..... A63B 67/00
(52) U.S. Cl. ..... 273/440.1; 273/108.1
(58) Field of Search ..... 273/108, 108.1, 273/440, 440.1

(56) References Cited

U.S. PATENT DOCUMENTS

| | | | | |
|---|---|---|---|---|
| D. 258,674 | * | 3/1981 | Balleis | D21/462 |
| 2,601,739 | | 7/1952 | Nicholls . | |
| 2,937,025 | | 5/1960 | Bellak . | |
| 3,592,468 | * | 7/1971 | Simendinger, Jr. | 463/47.1 |
| 3,947,030 | | 3/1976 | Goldfarb et al. . | |
| 4,020,588 | | 5/1977 | Barlow et al. . | |
| 4,319,751 | | 3/1982 | Kurushima et al. . | |
| 4,335,876 | * | 6/1982 | Westernoff | 273/447 |
| 4,597,574 | * | 7/1986 | Wolfe | 273/403 |
| 5,275,401 | | 1/1994 | Llorens . | |

FOREIGN PATENT DOCUMENTS

| | | | | |
|---|---|---|---|---|
| 1458596 | * | 11/1966 | (FR) | 273/85 R |
| 1018658 | * | 5/1983 | (SU) | 273/85 R |

* cited by examiner

*Primary Examiner*—Raleigh W. Chiu
(74) *Attorney, Agent, or Firm*—John Smith-Hill; Smith-Hill and Bedell

(57) ABSTRACT

Two playing pieces each include a body portion, a shield having at least two hinged segments attached to the body portion, a first control mechanism operable to select one of the hinged segments as a blocked segment, a projecting element attached to the body portion and having a raised position and at least two lowered positions, and a second control mechanism operable to select one of the lowered positions as an active position. The two playing pieces can be placed on a track structure at opposite respective ends for movement towards each other along respective paths of movement. In one possible outcome, the projecting element of one of the playing pieces strikes the blocked segment of the shield of the other playing piece and in another outcome the projecting element strikes an unblocked segment of the shield of the other playing piece.

6 Claims, 5 Drawing Sheets

JOUSTING GAME

BACKGROUND OF THE INVENTION

This invention relates to a game playing apparatus.

Numerous games have been devised in which two players employ respective playing pieces in some form of contest and the player who achieves a desired result using his playing piece is the winner.

SUMMARY OF THE INVENTION

In accordance with a first aspect of the invention there is provided game playing apparatus comprising a track structure having first and second ends and defining first and second paths of movement from the first and second ends respectively each towards the opposite end of the track, first and second playing pieces which can be placed on the track structure at the first and second ends respectively for movement along the first and second paths of movement respectively, each playing piece including a body portion, a shield member having at least two hinged segments attached to the body portion, a first control mechanism operable to select one of the hinged segments as a blocked segment, a projecting element attached to the body portion and having a raised position and at least two lowered positions, and a second control mechanism operable to select one of the lowered positions as an active position.

In accordance with a second aspect of the invention there is provided game playing apparatus comprising a track structure defining a path of movement of playing pieces, two playing pieces moveable along the track towards each other from opposite respective ends of the track, each playing piece including a body portion, a shield member having at least upper and lower segments which are hingedly connected to the body portion, a first control mechanism actuable from behind the playing piece to select one of the segments, a projecting element which can be used to engage the other playing piece when the two playing pieces meet as they move towards each other along the track and to strike the other playing piece, the projecting element having a raised position and at least two lowered positions, and a second control mechanism for selecting one of the lowered positions as an active position, and wherein the projecting element falls from the raised position to the active lowered position when the playing piece moves along the track from an end of the track towards the other playing piece.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
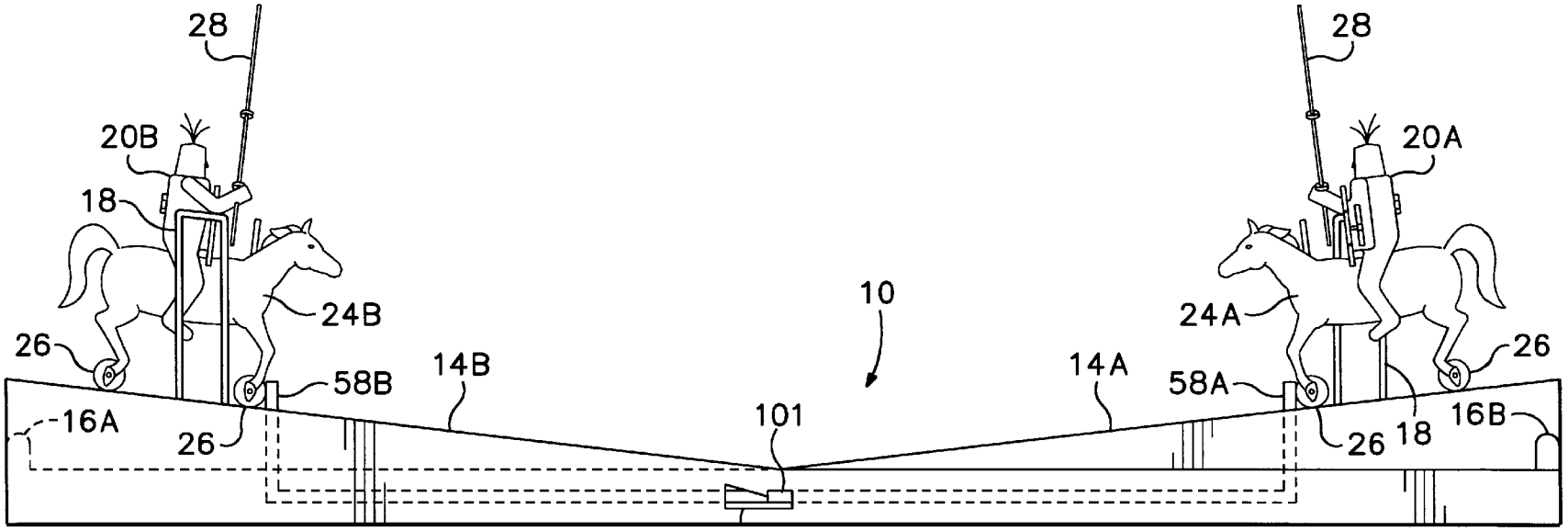
FIG. 1 is a side elevation of game playing apparatus in accordance with the present invention, the apparatus including a track structure and two playing pieces on the track structure.
Figure 2:
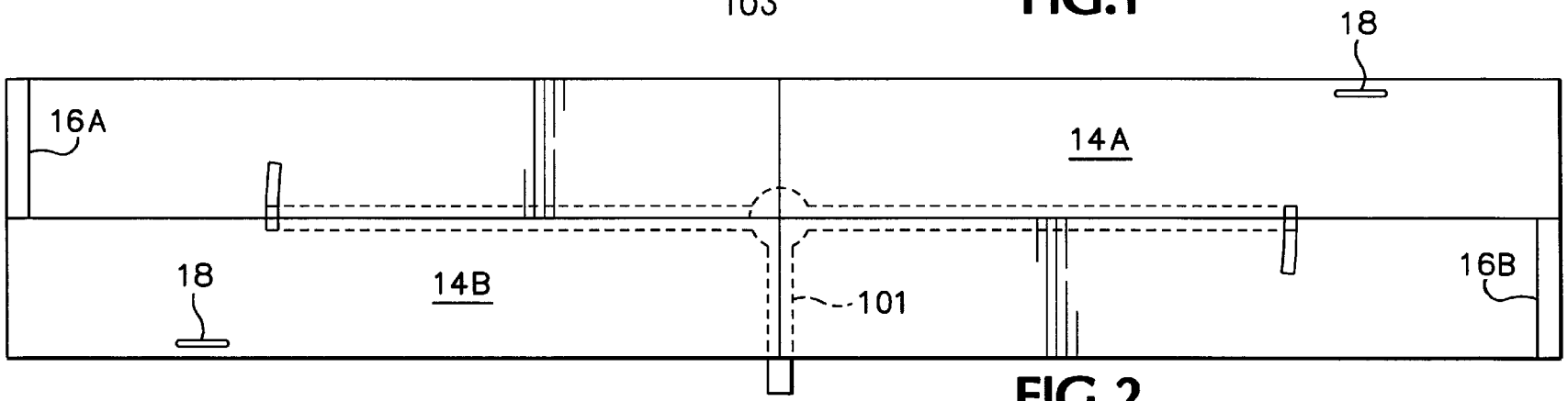
FIG. 2 is a top plan view of the track structure, FIGS. 3A and 3B, collectively referred to as FIG. 3, are respectively a left side elevation of one of the playing pieces, depicting a knight mounted on a charger, and a right side elevation of the knight, each drawn to an enlarged scale relative to FIGS. 1 and 2, FIGS. 4A, 4B and 4C, collectively referred to as FIG. 4, are respective partial right side elevations of the knight.

The game playing apparatus shown in the drawings includes a track structure 10 which rests on a flat surface and has two parallel ramps 14*a*, 14*b* extending downwards each from one end of the track towards the opposite end of the track. The two ramps 14*a* and 14*b* cross half-way along the track and end in respective stops 16*a* and 16*b*. Looking from one end of the track towards the opposite end, the ramp that is inclined downwards is to the right of the ramp that is inclined upwards. The track structure is hollow and accommodates a control mechanism which will be described in detail below. A rail 18 is provided adjacent each ramp near its upper end for a purpose which will be described.

The game playing apparatus further includes two playing pieces, each consisting of a simulation or representation of a knight in armor 20 mounted on a charger 24. The charger has wheels or rollers 26 which allow the charger to roll down the ramp 14 under gravity. The track and the rollers are configured so that the charger rolls along a substantially rectilinear path and will not deviate significantly from that path.

Figures 3A, 3B:
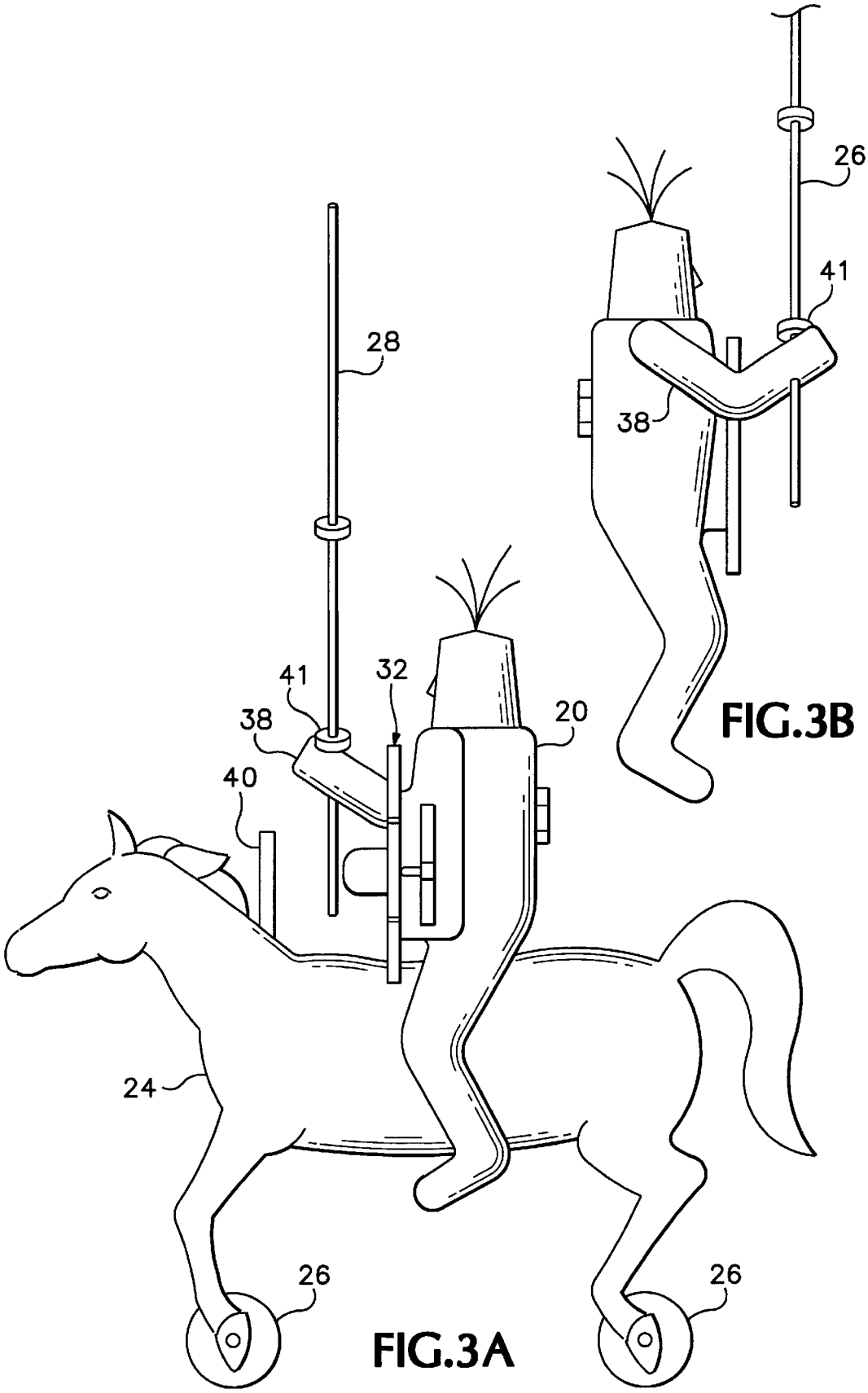
Figure 4A:
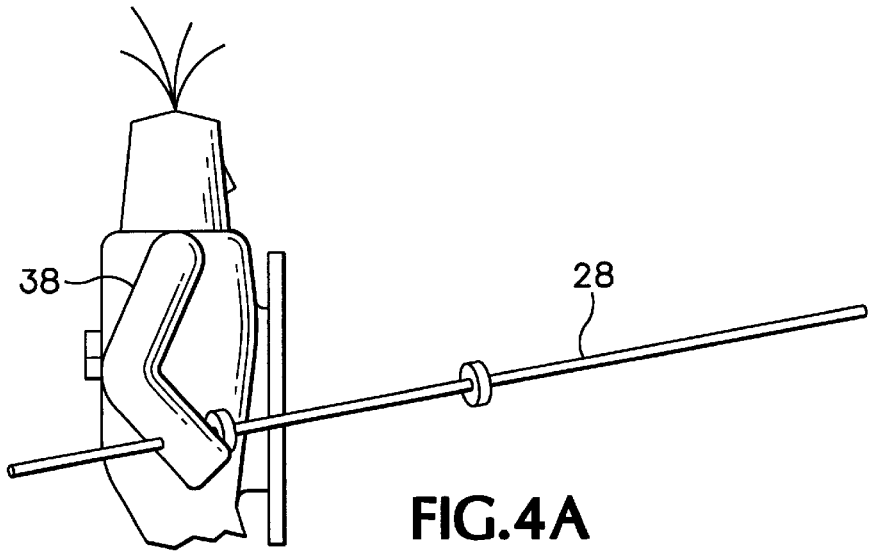
Figure 4B:
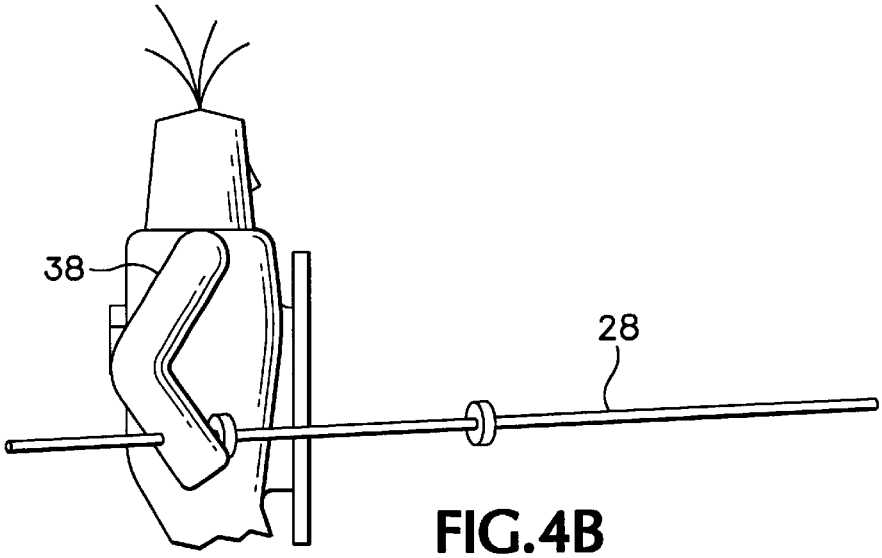
Figure 4C:
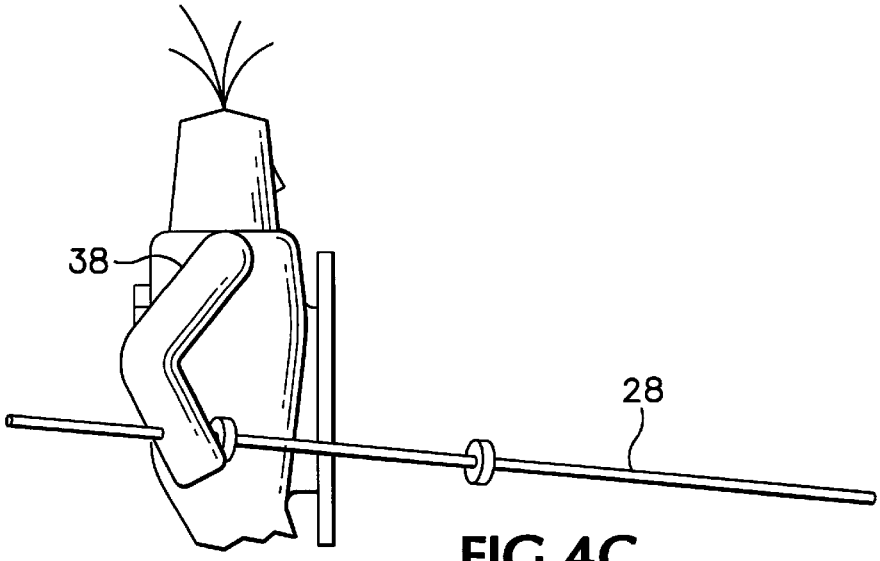
Figure 5A:
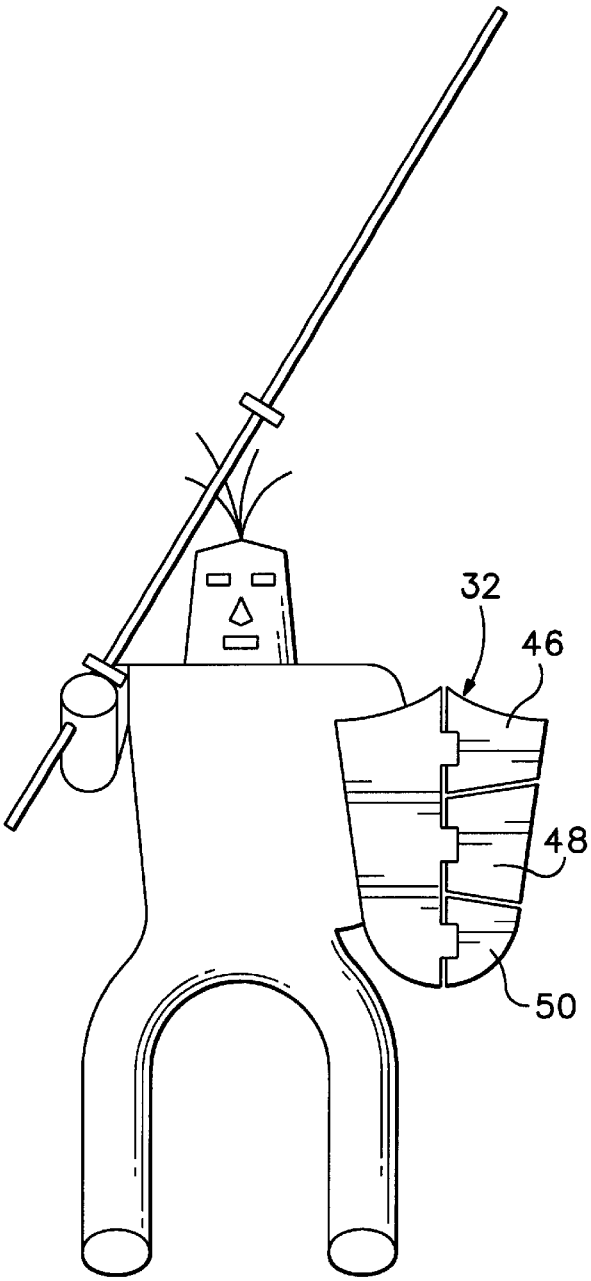
FIGS. 5A and 5B are front and rear elevations of the knight.
Figure 5B:
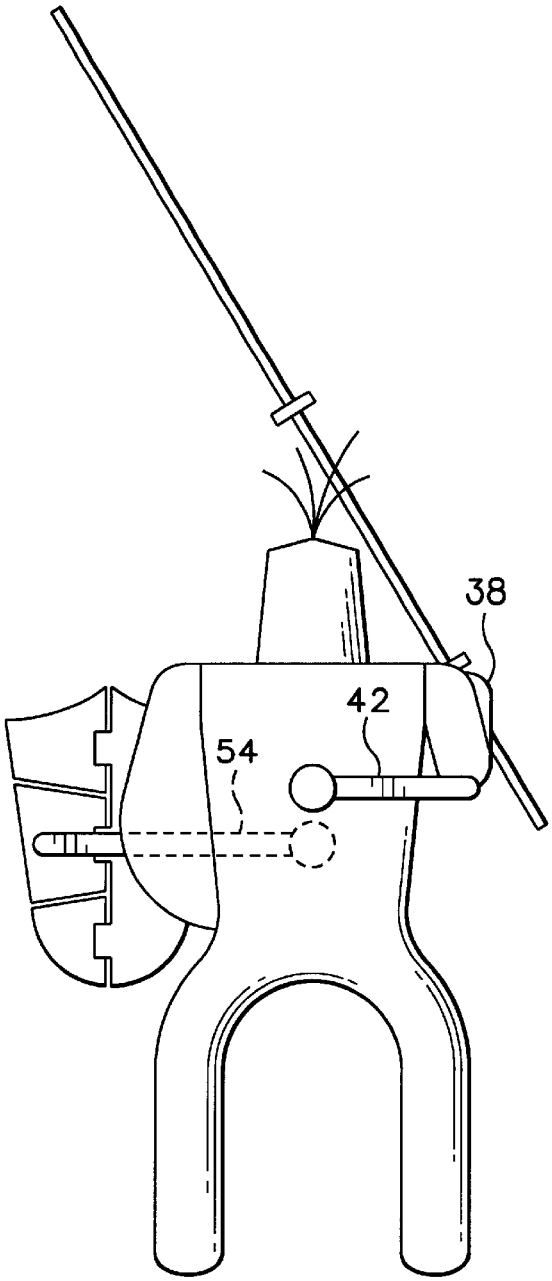
Figure 6:
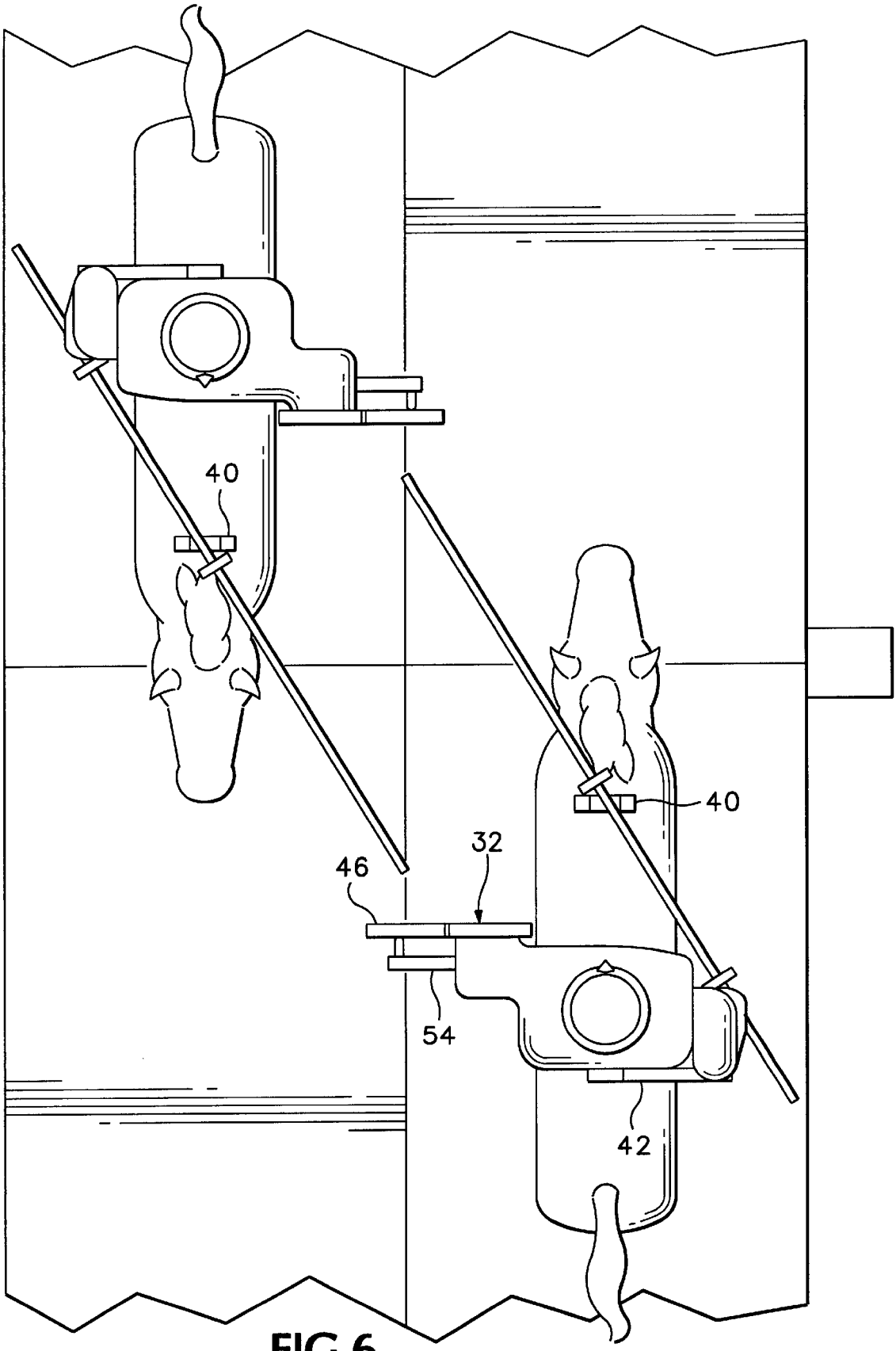
FIG. 6 is a partial top plan view of the track structure and playing pieces.

Each knight 20 is provided with a lance 28 held loosely at the free end of his right arm 38, which is pivotally attached to the torso at the shoulder so that the lance 28 can move under gravity from the inactive position shown in FIGS. 3 and 5 to an active position shown in FIG. 4. The lance includes a hand guard 41 and when the lance is in the inactive position, the weight of the lance is supported by the hand guard resting on the free end of the right arm of the knight. The charger includes a lance brace 40 which receives the lance when the lance pivots down from its inactive position to its active position. The lance 28 includes a transverse disk which is positioned just forward of the lance brace when the lance is in its active position. A control lever 42 projects from the knight's back and extends to the right for limiting downward pivotal movement of the right arm. Depending on the position of the control lever 42, the downward pivotal movement of the right arm stops at a position associated with upper, intermediate and lower positions respectively of the lance. The upper, intermediate and lower positions of the lance are shown in FIGS. 4A, 4B and 4C respectively. When the lance is in its active position, the tip of the lance is approximately halfway between the paths of the two playing pieces.

A shield 32 is firmly attached to a left arm structure of the knight. Referring to FIG. 5, the shield 32 is divided vertically into two halves. The right half of the shield is attached rigidly to the left arm structure and the left half of the shield is composed of upper, intermediate and lower segments 46, 48 and 50 which are separately hinged to the right half of the shield. A control lever 54 is mounted pivotally inside the knight's torso and extends to the left, projecting from the left arm structure. The control lever 54 can be positioned in one of three positions. In each position, the control lever 54 allows two of the segments of the left half of the shield to hinge but blocks hinging movement of the third segment. When a charger rolls down the ramp, the left half of the shield sweeps through a strike zone which partially overlaps the two ramps.

The control mechanism for the track includes retractable stop elements 58a and 58b which, in an active position, project upwards from the ramps 14A and 14B respectively to prevent the chargers from rolling down the ramps and in an inactive position are retracted from the ramps and allow the chargers to roll down the ramps. The stop elements 58A, 58B are connected to opposite respective ends of a longitudinal rod which is accommodated in the track structure and is connected to a transverse rod 101. The transverse rod 101 is pivotally connected at one end to the track structure and its opposite end projects from the interior space of the track structure through a slot 103. When the free end of the rod 101 is held in the latched position at the right end of the slot 103, as seen in FIG. 1, the stop elements 58 are in the active position and hold the chargers against rolling down the ramp. When the transverse rod 101 is unlatched and moves to the left end of the slot 103, the stop elements 58 are retracted to the inactive position and allow the chargers to roll down the respective ramps.

In use of the illustrated game playing apparatus, the transverse rod 101 is initially latched at the right end of the slot 103 and the stop elements 58 are in the active position. Each player turns the right arm of his knight to position the lance in the inactive position. The players place their playing pieces on the respective ramps, behind the stop elements 58, with the right arm of the knight resting on the rail 18 so that the right arm is supported and does not pivot downwards. Each player sets the two control levers 42 and 54 of his knight having regard to his expectation of the settings that the other player will select. One of the players then releases the rod 101 from its latched position so that the stop elements 58 are retracted to the inactive position and the two chargers roll down the respective ramps. As each charger rolls down the ramp, the right arm moves beyond the rail 18 and the right arm then pivots downwards and the lance comes to rest at the upper, intermediate or lower position, depending on the setting of the control lever 42. In the active position of the lance, the tip is in the strike zone between the two ramps. When the two playing pieces meet, the tip of the lance of each playing piece strikes one of the three segments of the left half of the shield of the other playing piece. There are three possible outcomes. In a first case, the lance of each knight strikes a hinged segment of the shield of the other knight. The two hinged segments allow the respective lances to pass and the two knights continue down the respective ramps. This is a tie. In a second case, the active position of the lance of one playing piece (the winner) is such that the winner's lance strikes the blocked segment of the shield of the other playing piece (the loser) whereas the loser's lance strikes an unblocked segment of the winner's shield. When the loser's lance strikes the winner's shield, the struck segment of the winner's shield hinges and no significant force is applied to the winner's shield. When the winner's lance strikes the loser's shield, momentum is transferred to the loser. The knight is seated fairly loosely on the charger and the loser's knight is pushed backwards and is dislodged from the charger, releasing the lance from the free end of the right arm. A corresponding impact is applied to the winner's lance as a reaction force, but the transverse disk and the lance brace transfer the force to the charger. The charger is heavier than the knight and the reaction force is not sufficient to dislodge the winner's charger from the ramp.

In the third case, the lance of each knight strikes the blocked segment of the shield of the other knight and both knights are dislodged from their respective chargers. This also is a tie.

It will be appreciated that the invention is not restricted to the particular embodiment that has been described, and that variations may be made therein without departing from the scope of the invention as defined in the appended claims and equivalents thereof.

What is claimed is:

1. Game playing apparatus comprising:

a track structure having first and second ends and defining first and second paths of movement from the first and second ends respectively each towards the opposite end of the track, first and second playing pieces which can be placed on the track structure at the first and second ends respectively for movement along the first and second paths of movement respectively, each playing piece including:

a body portion, a shield member having at least two hinged segments attached to the body portion, a first control mechanism operable to select one of the hinged segments as a blocked segment, a projecting element attached to the body portion and having a raised position and at least two lowered positions, and a second control mechanism operable to select one of the lowered positions as an active position.

2. Game playing apparatus according to claim 1, wherein each playing piece includes a mount on which the body portion is loosely seated.

3. Game playing apparatus according to claim 1, wherein the shield member has upper, intermediate and lower hinged segments attached to the body portion and the first control mechanism is operable to select a single hinged segment as a blocked segment.

4. Game playing apparatus according to claim 1, wherein the body portion includes a human figure and the projecting element is an elongate rod-form element.

5. Game playing apparatus according to claim 4, wherein the projecting element is held in a right hand of the human figure, and each playing piece further includes a mount on which the human figure is loosely seated, the mount including a brace which cooperates with the projecting element when in its active position to transfer force applied to the projecting element to the mount portion of the playing piece.

6. Game playing apparatus comprising:

a track structure defining a path of movement of playing pieces, two playing pieces moveable along the track towards each other from opposite respective ends of the track, each playing piece including a body portion, a shield member having at least upper and lower segments which are hingedly connected to the body portion, a first control mechanism actuable from behind the playing piece to select one of the segments, a projecting element which can be used to engage the other playing piece when the two playing pieces meet as they move towards each other along the track and to strike the other playing piece, the projecting element having a raised position and at least two lowered positions, and a second control mechanism for selecting one of the lowered positions as an active position, and wherein the projecting element falls from the raised position to the active lowered position when the playing piece moves along the track from an end of the track towards the other playing piece.

* * * * *